United States Patent [19]

Brook et al.

[11] 4,095,999

[45] Jun. 20, 1978

[54] HEAT-TREATING METHOD

[75] Inventors: Greville B. Brook, Bucks, England; Peter L. Brooks, Palo Alto; Roger Iles, Foster City, both of Calif.

[73] Assignee: Raychem Corporation, Menlo Park, Calif.

[21] Appl. No.: 735,737

[22] Filed: Oct. 26, 1976

Related U.S. Application Data

[60] Division of Ser. No. 550,847, Feb. 18, 1975, abandoned, which is a continuation-in-part of Ser. No. 417,067, Nov. 19, 1973, abandoned.

[30] Foreign Application Priority Data

Nov. 17, 1972 United Kingdom ..... 52343/72

[51] Int. Cl.[2] ..... C22F 1/00; C22F 1/08

[52] U.S. Cl. ..... 148/11.5 R; 148/11.5 C

[58] Field of Search ..... 148/11.5 R, 11.5 C, 148/13.2; 75/157.5

[56] References Cited

U.S. PATENT DOCUMENTS

| | | | |
|---|---|---|---|
| 2,394,673 | 2/1946 | Edmunds | 75/157.5 |
| 3,567,523 | 3/1971 | Jackson et al. | 148/11.5 R |
| 3,594,239 | 7/1971 | Wang | 148/13 |
| 3,783,037 | 1/1974 | Brook et al. | 148/11.5 R |

OTHER PUBLICATIONS

Titov, P. et al., Hysterisis in Martensitic Transformation on Alloy of Cu–Sn; Akad. Nauk., UKr.SSr; May 1970; pp. 199–204.

Pops, H.; Martensite in Ternery Cu–Zn Based Beta--Phase Alloys; in Trans. AlME, 239; May 1967; pp. 756–759.

*Primary Examiner*—W. Stallard

*Attorney, Agent, or Firm*—Lyon & Lyon

[57] ABSTRACT

The present invention relates to methods for modifying the temperatures at which metallic compositions capable of undergoing reversible transformation from the austenitic state to the martensitic state will undergo such transformation. According to the present invention, the transformation temperature of such metallic compositions may be raised by slowly heating a metallic composition which is in the martensitic state to a temperature above that at which transformation to the austenitic state normally occurs. Usually the slow heating is terminated and the composition cooled to a temperature below the temperature at which slow heating was terminated.

43 Claims, 11 Drawing Figures

DIMENSIONAL CHANGE DURING SHAPE MEMORY CYCLE

MOVEMENT OF THE RECOVERY RANGE-TO HIGHER TEMPERATURE

APPLIED STRAIN VERSUS FIGURE OF MERIT

COPPER - ALUMINUM - ZINC (BALANCE) ALLOYS
COMPOSITION VERSUS FIGURE OF MERIT
AGED SAMPLES
100 C SLOW HEATING LIMIT
WEIGHT PERCENT ALUMINUM
WEIGHT PER CENT COPPER
40
20
2
3
4
5
6
66
67
68
69
70
71
72

HEAT-TREATING METHOD

This is a division of application Ser. No. 550,847 filed Feb. 18, 1975 now abandoned.

RELATED APPLICATIONS

This application is in-turn a continuation-in-part of application Ser. No. 417,067 filed Nov. 19, 1973, now abandoned.

FIELD OF THE INVENTION

This invention relates to heat recoverable articles and the methods by which they are obtained.

BACKGROUND OF THE INVENTION

Metallic compositions which are, generally speaking, alloys which have the properties of being capable of undergoing reversible transformation from the austenitic to the martensitic state are known.

Such alloys are, for example, those disclosed in U.S. Pat. Nos. 3,012,882; 3,174,851; 3,351,463; 3,567,523; 3,753,700; and 3,759,552, Belgian Pat. No. 703,649, and in British Patent Applications, Nos. 22372/69; 55481/69; 55482/69; 55969/69; and 5373/70 (now British Pat. No. 1,315,652; 1,315,653; 1,346,046 and 1,346,047) in the name of Fulmer Research Institute, the disclosure of each of which is incorporated herein by reference.

Such alloys are also disclosed in NASA Publication SP110, "55-Nitinol-the alloy with a memory, etc." (U.S. Government Printing Office, Washington, D.C., 1972), N, Nakanishi et al, Scripta Metallurgica 5, 433–440 (Pergamon Press 1971), the disclosures of which are likewise incorporated herein by reference.

These alloys have in common the feature of undergoing a shear transformation on cooling from a high temperature (austenitic) state to a low temperature (or martensitic) state. If an article made of such an alloy is deformed when in its martensitic state it will remain so deformed. If it is heated to return it to a temperature at which it is austenitic, it will tend to return to its undeformed state. The transition from one state to the other, in each direction, takes place over a temperature range. The temperature at which martensite starts to form on cooling is designated $M_s$ while the temperature at which this process is complete is designated $M_f$, each of these temperatures being those achieved at high, e.g., 100° C per minute, rates of change of temperature of the sample, i.e., the "basic" $M_s$, etc.. Similarly, the temperature of beginning and end of the transformation to austenite are designated $A_s$ and $A_f$. Generally, $M_f$ is a lower temperature than $A_s$, $M_s$ is a lower temperature than $A_f$. $M_s$ can be equal to, lower than or higher than $A_s$, for a given alloy composition and which also depends upon the alloy's prior thermomechanical history. The transformation from one form to the other may be followed by measuring one of a number of physical properties of the material in addition to the reversal of deformation described above, for example, its electrical resistivity, which shows an anomaly as the transformations take place. If graphs of resistivity-v-temperature or strain-v-temperature are plotted, a line joining the points $M_s$, $M_f$, $A_s$, $A_f$ and back to $M_s$ forms a loop termed the hysteresis loop. For many materials $M_s$ and $A_s$ are at approximately the same temperature.

One particular useful alloy possessing heat recoverability or shape memory is the intermetallic compound TiNi, U.S. Pat. No. 3,174,851. The temperature at which deformed objects of the alloys return to their original shape depends on the alloy composition as disclosed in British Pat. No. 1,202,404 and U.S. Pat. No. 3,753,700, e.g., the recovery of original shape can be made to occur below, at, or above room temperature.

In certain commercial applications employing heat recoverable alloys, it is desirable that $A_s$ be at a higher temperature than $M_s$, for the following reason. Many articles constructed of the alloys are provided to users in a deformed condition and thus in the martensitic state. For example, couplings for hydraulic components, as disclosed in U.S. Pat. Applications No. 852,722 (now abandoned) filed Aug. 25, 1969 (Belgian Pat. No. 755,271), and No. 51809 (now abandoned) filed July 2, 1970, are sold in a deformed (i.e., an expanded) state, the disclosures of those applications being incorporated herein by reference. The customer places the expanded coupling over the components (for example, the ends of hydraulic pipe lines) to be joined and raises the temperature of the coupling. As its temperature reaches the austenitic transformation range, the coupling returns, or attempts to return, to its original configuration, and shrinks onto the components to be joined. Because it is necessary that the coupling remain in its austenitic state during use (for example, to avoid stress relaxation during the martensitic transformation and because its mechanical properties are superior), the $M_s$ of the material is chosen to be below any which it may possibly reach in service. Thus, the recovery, during services the material will remain at all times in the austentic state. For this reason, it has to be kept in, for example, liquid nitrogen until it is used. If, however, the $A_s$ which, as used herein, means that temperature which marks the beginning of a continous sigmoidal transition, as plotted on a strain vs. temperature graph, of all the martensite capable of transforming to austenite, to the austenitic state, could be raised if only temporarily, for example, for one heating cycle, without a corresponding rise in the $M_s$, then the expanded coupling could be maintained at a higher and more convenient temperature.

It is an object of the present invention to provide an alloy having for at least one heating cycle an $A_s$ higher than its $M_s$, or a raised $A_s$ if the alloy already has an $A_s$ higher than its $M_s$, and to raise the $A_s$ of an alloy, at least temporarily, relative to the $M_s$ of the alloy. Stated another way, this invention provides a means for retaining at least a useful portion of martensite at temperatures at which austenite would normally exist. Thus, the physical properties associated with martensite are retained at higher temperatures, at least until the material has been heated to a higher temperature.

SUMMARY OF THE INVENTION

According to the present invention there is provided a method of thermally preconditioning a metallic composition capable of undergoing a reversible transformation between an austenitic state and a martensitic state to impart to it an elevated $A_s$ temperature.

The present invention also provides metallic compositions having an elevated $A_s$ temperature.

The method of the invention comprises slowly heating the composition from a temperature at which it exists in the martensitic state to a temperature within or above its normal $A_s$–$A_f$ range at a rate which prevents substantial transformation of the composition to the austenitic state. If desired, heat recoverability can be imparted to the composition by deforming it while in the martensitic state from an original configuration prior to or subsequent to the termination of the slow heating.

Metallic compositions conditioned in this way retain a significant portion of the properties associated with their martensitic state up to the temperature at which slow heating was terminated. Reversion of the composition to its austenitic state is accomplished by rapidly heating the composition above the temperature at which the slow heating step was terminated. If prior to the fast heating step the composition is deformed, recovery to the original shape is occasioned by the fast heating step.

DETAILED DESCRIPTION OF THE INVENTION

In an article by P. V. Titov and L. G. Khandros, Naukova Dumka, Kiev, 1970, 199–204, it is disclosed that by means of a rapid heating rate from temperature $M_f$, it is possible to lower the $A_s$, as measured by electrical resistivity of an undeformed copper-tin alloy to −125° C, and conversely, when employing a slow heating rate, the $A_s$ was observed at 90° C. The authors state, however, that the copper-tin system appeared to be unique; with an undeformed copper-aluminum-nickel alloy, changes in heating rate from 15 to 0.01° C/sec. (those described in this paragraph as rapid and slow) did not affect $A_s$.

The present invention provides a heat-recoverable metallic composition having for at least one heating cycle an $A_s$ higher than its $M_s$, or a raised $A_s$ if the alloy already has an $A_s$ higher than its $M_s$, and a method of raising the $A_s$ of an alloy, at least temporarily, relative to the $M_s$ of the alloy. Stated another way, this invention provides a means for retaining at least a useful portion of martensite at temperature at which austenite would normally exist. Thus, the physical properties associated with martensite are retained at higher temperatures, and if the article has been deformed, the temperature at which it will recover, or tend to recover, its original configuration is increased.

The present invention also provides a method for raising for at least one heating cycle the $A_s$ of a alloy relative to its $M_s$ which comprises slowly, e.g., usually at less than 1° C/min., heating the alloy from a temperature below its $M_f$ to a temperature in the range to which it is desired to change the $A_s$. The alloy can then be cooled to any temperature below or held at that to which it has been slowly heated.

The alloy can be rendered heat recoverable by deforming it while in the martensitic state prior to or subsequent to the slow heating step from the configuration it possessed while in the austenitic state. When the alloy is to be used, it is simply heated again at any convenient fast rate, e.g., 5° C/min. or greater; preferably 100° C/min. or greater, and the $A_s$ will be found to be determined by and often to be approximately at the temperature to which it was heated slowly. The present invention also provides an alloy having the properties produced by the above method. This method is referred to hereinafter as "pre-conditioning", and the resulting alloy as "preconditioned".

Figure 1:
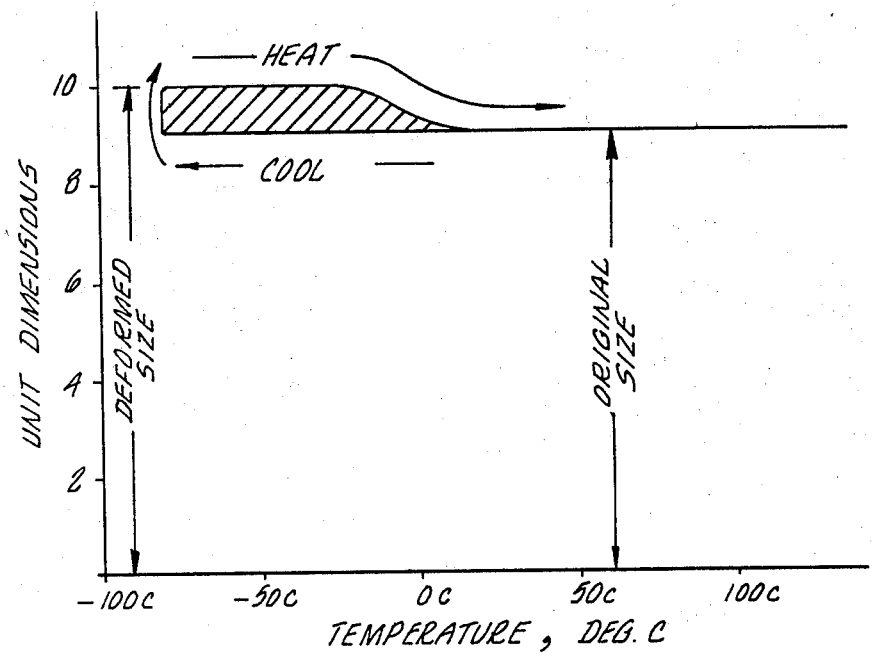
FIG. 1 is a representation in graphic form of the dimensional change exhibited by a heat recoverable article.
Figure 2:
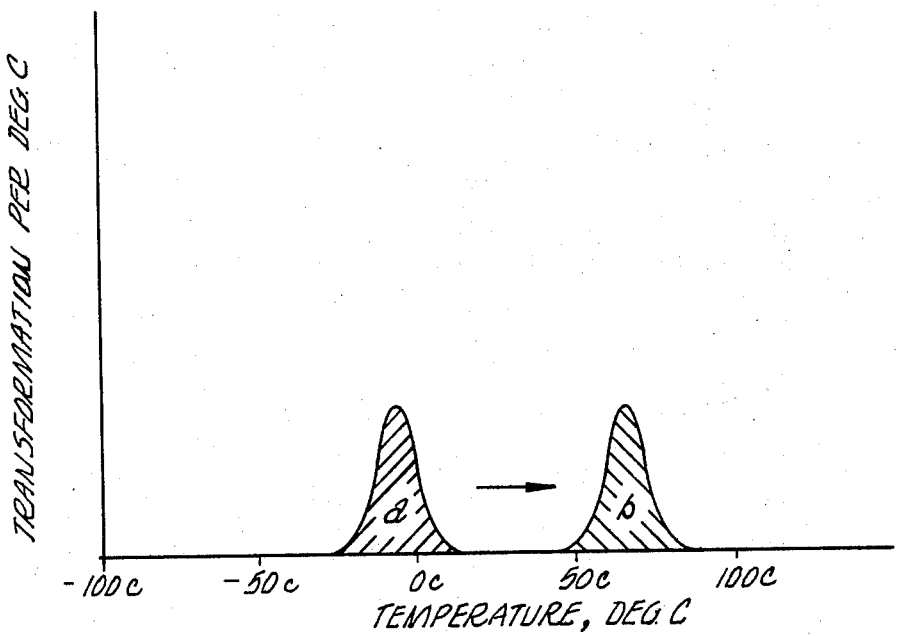
FIG. 2 graphically depicts the elevation of the temperature range over which transformation from martensite to austenite occurs occasioned by the method of this invention.

With reference to FIG. 1, for the purpose of illustration, a part that must be serviceable to temperatures as low as −30° C will be considered. For this, an alloy would be selected which has the beginning of the $M_s$ transformation on cooling at or below −30° C. For copper-based beta phase alloys, the temperature at which recovery of original shape from a deformed condition, as indicated by the shaped portion of FIG. 1, would begin on heating would also be approximately −30° C and the return to the original shape would be completed over the next 40 to 50° C. Thus, by room temperature, the part would have regained its original shape as shown in FIG. 1 of the accompanying drawings. For purposes of comparing recovery characteristics, a more useful graphic presentation is achieved by recording the amount of recovery which occurs during each interval of heating, that is, by plotting the first derivative of the curve in FIG. 1, see FIG. 2. By the present invention, the recovery range can be moved from its usual position at (a) in FIG. 2 to the new position (b).

One alloy that begins to tranform on cooling at about −30° C has a nominal composition 66.45 wt. % Cu, 31.55 wt. % Zn, 2.00 wt. % Si. The alloy can be melted and worked into its desired final shape by conventional means. The shaped part is then heated into the all-beta field, i.e., 700° C or higher, but below 950° C. After several minutes at this temperature, the part is quenched into water, then cooled for example by solid carbon dioxide and ethyl alcohol to transform it to the low temperature crystal structure. At the low temperature, the part is deformed to its new shape; good results are obtained with strains of 6–10%. The part is then heated slowly, e.g., 0.25 deg. C/min., in order to delay transformation until the desired recovery temperature is reached, e.g., + 40° C. The part is cooled back to room temperature. When the part is to be returned to its original shape, it is heated rapidly, e.g., usually about 100° C per minute. Recovery will begin in the vicinity of +40° C and will be complete by about 100° C. On cooling, transformation to the low temperature phase will not occur above −30° C. If the part is cooled again to −79° C and redeformed, then rapidly heated, recovery begins at −30° C.

It is believed that there may be a maximum in temperature increase in $A_s$ that can be achieved by the process of the invention. For example, on raising the temperature of $\beta$-brass, there is a tendency for the material to change to an equilibrium mixture of $\alpha$ and $\beta$ materials. This would prevent any further useful rise in $A_s$. By the process of the invention, however, the $A_s$ of certain alloys has been raised by 100° C, and it is not believed that this is the maximum achievable.

Applicability of the invention is to some extent dependent on the composition of the alloy. Whereas some response to control of the recovery temperature range was found in the alloys described in the aforementioned Fulmer applications and patents a more restricted range responded significantly better. The composition range of good response in the Cu-Zn-Si system includes alloys in which the normal $M_s$ transformation is as low as about −80° C. Most of the applications suggested above require the start of transformation on cooling to be below room temperature. As will be shown later, this restriction does not apply to all applications. Certain alloy compositions in which transformation on cooling begins at or above room temprature have been found to respond well to the process of this invention. Alloys with good response and with the beginning of transformation on cooling in the vicinity of +100° C have been found in the Cu-Zn-Al and Cu-Zn-Si systems.

The amount of recovery which occurs in the elevated recovery range is often decreased if the alloy is held at the temperature at which slow heating is stopped for an extended time before commencing rapid heating or cooling to a lower storage temperature.

For certain alloys in which quenching is required to ensure a structure at room temperature capable of undergoing a reversible martensite-austenite transformation, it is preferred that the alloy initially be quenched from a high temperatue (for example, about 800° C) to a temperature preferably above the M at such a rate that it is still substantially austenitic. Some of these alloys have the tendency to lose austenite-martensite reversibility. Inhibition of such loss may be achieved by holding the alloy at the quenchant temperature or some moderately elevated temperature. For example, in the case of alloys whose $M_s$ is from about 0° C to about 20° C, holding at from about 50° C to 150° C for about 10 minutes at the higher temperatures to 24 hours or even several days at the lower temperatures is usually sufficient. The latter procedure is referred to as "aging" and is the subject of our copening application, Ser. No. 550,556 filed of even date herewith as a continuation-in-part of our application Ser. No. 417,067 filed Nov. 19, 1973 the disclosure of which is incorporated by reference herein.

For alloys with a room temperature basic $M_s$, 50° C proves to be a convenient quenchant and aging temperature. If the alloy has been quenched to a lower temperature (i.e., one at which transformation to the martensite does take place) it is then aged, i.e., preferably heated to a temperature at which the alloy is transformed to the austenite and held at such temperature for a suitable time. Preferably, the aging process is carried out as soon as possible after quenching.

It has thus been found that this treatment of alloys above any temperature at which martensite exists, can be employed to prevent or inhibit loss of the reversible austenite-martensite transformation when the materials are stored. The higher the aging treatment temperature, the shorter the treatment time needs to be.

It is believed that, for a given alloy, there is a range of heating rates, up to a maximum, which qualify as "slow", and a range of rates, from a minimum, which qualify as "fast". Between this maximum and minimum, there is a critical range wherein the $A_s$ temperature will vary between its normal value and a very high temperature.

It is not possible to define numerical ranges for "fast" and "slow" which will be appropriate for all alloys, because this depends on a number of factors. One is that physico-chemical processes are temperature-dependent, and such processes take place very much more slowly at, say −40° C than at +40° C. For an alloy having $M_s$ at −40° C, it is generally true that both "slow" and "fast" heating rates will be slower than an "otherwise similar" material having $M_s$ at 40° C. Further, as an otherwise similar material will necessarily have slightly different proportions of the component elements, these elements and proportions will in any case affect the limits of "fast" and "slow".

Further, required heating rates are dependent on alloy content and aging time. For example, in an alloy of copper-zinc-silicon with, say, a 1% silicon content or which has been subjected to a short aging time, the critical values of both "slow" and "fast" heating rates are higher than in material with a lower silicon content or longer aging time. It is a matter of routine experiment to determine preferred and critical rates for a given alloy. Suffice it to say, however, that for a given alloy, there will be an upper limit for "slow" heating and a lower limit for "fast" heating, and these limits may be readily ascertained for the given alloy by simple routine experiment.

Preferably, the alloy is an intermetallic compound. Among suitable alloys there may be mentioned copper-zinc and copper-aluminum alloys which preferably contain relatively small proportions of aluminum, silicon, tin or manganese, or mixtures thereof which alloys may, it is believed, contain up to about 20% or more weight percent (based on the weight of copper and zinc or aluminum of the third component or the total of the additional components. To achieve useful amounts of recovery, the alloy should have an elongation to failure in the martensitic state of at least about 5%. It will be appreciated that the proportion of metals other than copper and zinc affects the transition temperature and other properties of the alloys. Suitable alloys for use in the present invention include 69.7% Cu, 26.3% Zn, 4% Al; 62.2% Cu, 37.3% Zn, 0.5% Al; and 80.5% Cu, 10.5% Al, 9% Mn. As examples in this specification, there will be discussed in some detail alloys having about 65% copper to 35% zinc, with optional additions of up to 2% or even 3% silicon or up to 3 or 4½% aluminum, these being weight percentages. The processes of the invention are applicable to alloys having, for example, $M_s$ temperatures lower or higher than ambient, and to alloys, for example those based on gold or silver, other than copper-based.

Further alloys are those disclosed in the above-mentioned Fulmer Research Institute's patents and applications.

In the thermal preconditioning method of the invention, the material may be deformed either before the initial slow heating, or after the slow heating, or after the slow heating and subsequent cooling, the deformation taking place in each case in the substantially martensitic state advantageously below $M_f$ and preferably just below $M_f$.

Variables which must be borne in mind when operating the method of the invention are as follows:

In the case of copper-zinc and copper-aluminum alloys, to be capable of undergoing a reversible austenite-martensite transformation, the alloy must be substantially in the beta-phase. An alloy having greater than about 70% beta-phase normally exhibits properties substantially the same as a pure beta-phase material. Accordingly, in those cases where it is necessary to heat the alloy to a high temperature to initially obtain a beta-phase, a temperature should be selected at which at least a substantial portion of the alloy will exist in the beta-phase. The temperature range in which an alloy becomes substantially beta-phase varies as the alloy composition varies. For copper based alloys this phenomenon may occur as low as about 700° C.

The alloy should be quenched to a temperature at which the beta-phase exists as a meta-stable state, i.e., without a significant tendency to revert to the $\alpha$-phase. Furthermore, the cooling rate to the quenchant temperature should be rapid enough that $\alpha$-phase precipitation on cooling is not significant. Quenching to below $M_s$ may adversely affect the heat-recoverable properties, whereas in some cases quenching to too much above the $M_s$ may not give sufficiently rapid quench to prevent $\alpha$-phase precipitation in the copper alloys mentioned above. The preferred quenchant temperature is one that does not adversely affect heat-recoverable behaviour and about 20° C is convenient in practice especially for alloys with $M_s$ below 0° C.

The heating rate from the low temperature martensite is important. Qualitatively a "slow" heating rate is one which is sufficiently slow to substantially prevent martensite reversal to austenite at and above the normal $A_s$ temperature. Fo example, rates of 0.01 to 1.0 degrees centigrade/minute are believed to be suitable for copper-zinc alloys containing aluminum and/or silicon. A "fast" heating rate is one that allows a normal $A_s$ temperature when heating directly from the martensite, or one that enables martensite reversion to austenite at a chosen higher $A_s$ temperature when it is used after "slow" heating.

Whereas the process can be used to control the recovery temperature range of unstrained samples, the application of strain interacts with the composition in determining optimum conditions for control of the recovery range. For example, as the strain is increased, lower concentrations of silicon give optimum response in the Cu-Zn-Si system.

Stress, also, must be taken into consideration since the cooling transformation range moves to higher temperatures with higher stress. Similarly, the temperature needed for complete recovery on heating is higher if the part recovers under stress or becomes stressed as a consequence of recovering.

Figure 7:
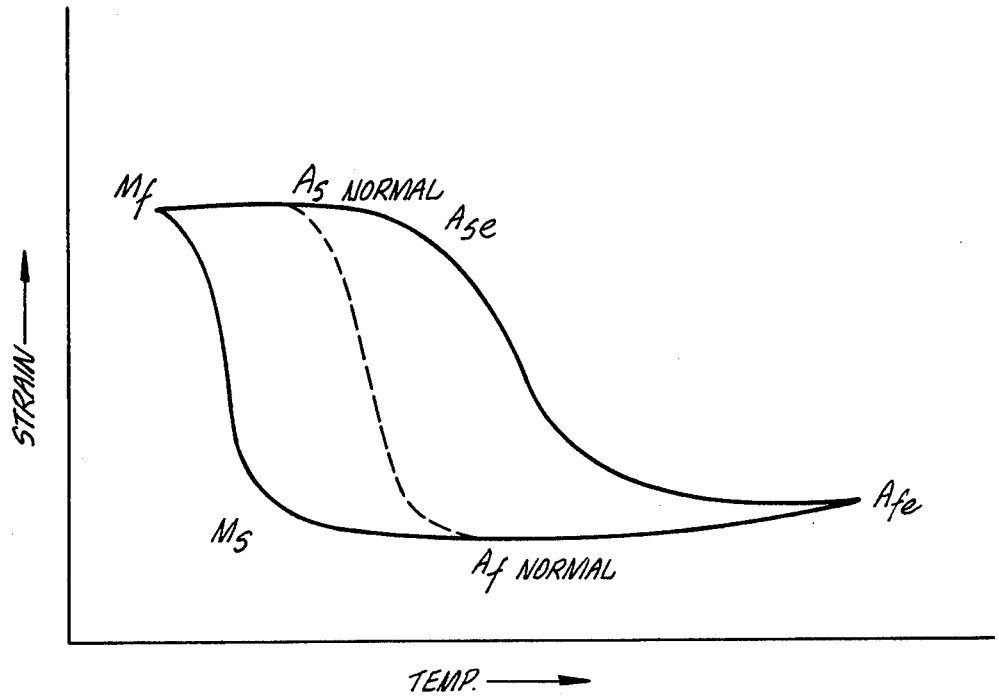
FIGS. 7 and 8 show the effect of heating on the recovery properties of a heat recoverable alloy.
Figure 8:
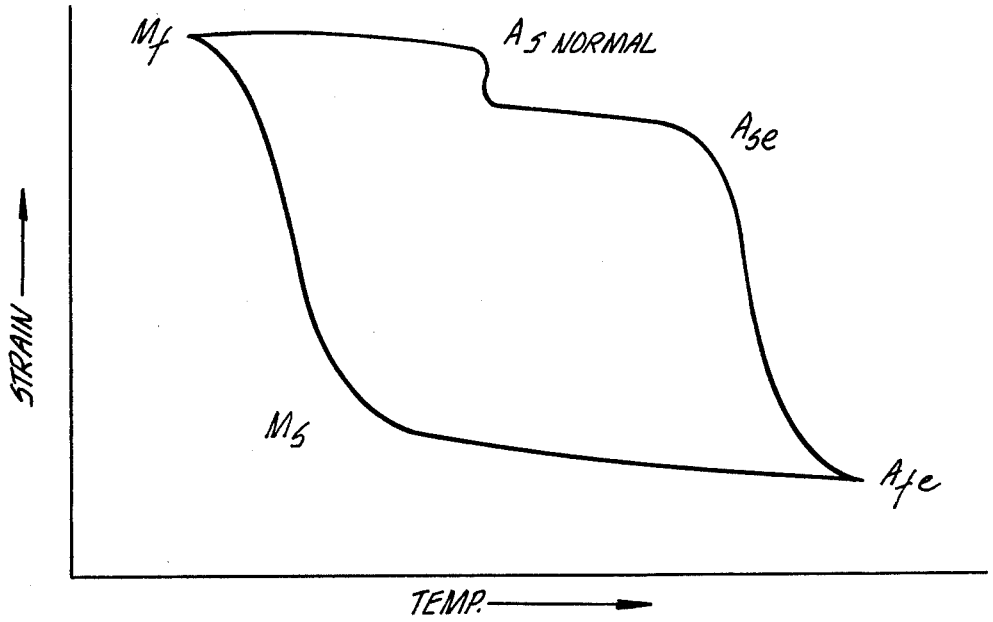

As shown in FIGS. 7 and 8, the effect of the slow heating treatment of the present invention may, as shown in FIG. 7, be to create a new $A_s$ indicated as $A_{se}$, at which substantially all of the heat recovery begins to occur upon the application of heating for recovery purposes. Alternatively, as shown in FIG. 8, the effect of the slow heating treatment of the present invention may be to create a new $A_{se}$ while retaining some manifestation of the normal $A_s$. While the applicants are not to be bound to any particular theory of operation of their invention, it is believed that the retention of some manifestation of the normal $A_s$ may result from inherent dominance of the rate of heat recovery at the low heating rate over the expansion of the hysteresis loop at normal $A_s$ or, alternatively, may be created intentionally by performing the initial portion of the slow heat treatment of the present invention at a rate rapid enough to cause some heat recovery at normal $A_s$.

It is to be understood from the foregoing that $A_{se}$ will be determined by that temperature at which slow heating is terminated. Slow heating may be terminated either by cooling or by initiating rapid heating which, if performed for a sufficient length of time, will result in complete transformation of all of the transformable martensite which is present at the time rapid heating is initiated. Thus, it is contemplated by and within the scope of the present invention to create a new $A_{se}$ at which useful recovery of an article made from a metallic composition so treated can be initiated.

The configuration in either recoverable or recovered state of articles prepared according to the present invention will depend upon the end use to which the articles are to be put. For example, cylindrical articles may be prepared such that they contract radially inwardly or expand radially outwardly or the configuration may change from twisted to nontwisted or vice versa, or the article may undergo a change in length, or the transition may be from an I to an L shape, etc.

Thus, stated simply, the present invention includes a process for controlling the recovery temperature of heat recoverable metallic articles such that the article can be provided with a pre-set recovery range which may be varied over substantial limits simply by terminating slow heating at a selected point.

The products of the present invention will be martensitic over a broader temperature range than products having the same composition but not subjected to treatment according to the present invention. Since martensitic compositions have excellent damping properties, are capable of undergoing deformation without fatigue, deform easily, and have a low Young's modulus, the present invention makes available a wider range of metallic commpositions having these properties than were previously available.

EXAMPLE 1

A series of experiments was conducted to determine the degree of response of various compositions in the Cu-Zn-Si and Cu-Zn-Al systems to the thermal preconditioning process of this invention. Alloy samples were cast from melts having different ratios of copper, zinc, and either silicon or aluminum. The castings were hot-rolled into strips, cut into specimens about 37mm × 3mm × 0.75 mm. All specimens were heated until they entered the high-temperature, all-beta phase, then quenched into water. Half the samples were aged at 100° C for 10 minutes, the other half were not aged. All the samples were deformed by bending at −79° C to cause an outer fibre strain of 6%. After deformation, the samples were released and measured to determine how much strain was retained. Specimens from the aged and unaged groups were then heated according to one of the three following methods: (1) heated rapidly by immersion in liquid at 40° C, cooled to room temperature and measured to determine how much strain was recovered, then heated rapidly by immersion in liquid at 200° C and again returned to room temperature to determine how much additional recovery of strain occurred; (2) slowly heated at a rate of 0.25 deg. C per minute from −79° C to +40° C, cooled to room temperature, measured to determine how much strain was recovered, then heated rapidly by immersion in liquid at 200° C, cooled to room temperature and measured to determine how much additional recovery occurred; or (3) treated as (2), except that the slow heating rate was 1° C per 24 minutes, instead of 0.25° C per minute.

A "figure of merit" for the responsiveness of each composition tested to control of the recovery temperature range is obtained by expressing as a percent the recovery occurring above 40° C for slowly-heated specimens, less the recovery above 40° C for rapidly-heated specimens, divided by 5% (which is the ideal recovery after the elastic springback which accompanies release of the bending stress) i.e., $$\text{Figure of Merit} = 100 \times \frac{\text{recovery above 40° C in slowly heated specimens} - \text{recovery above 40° C in rapidly heated specimens}}{5}$$

Compositions found especially suitable for use in the invention will now be described in greater detail with reference to the drawings.

Figure 3A:
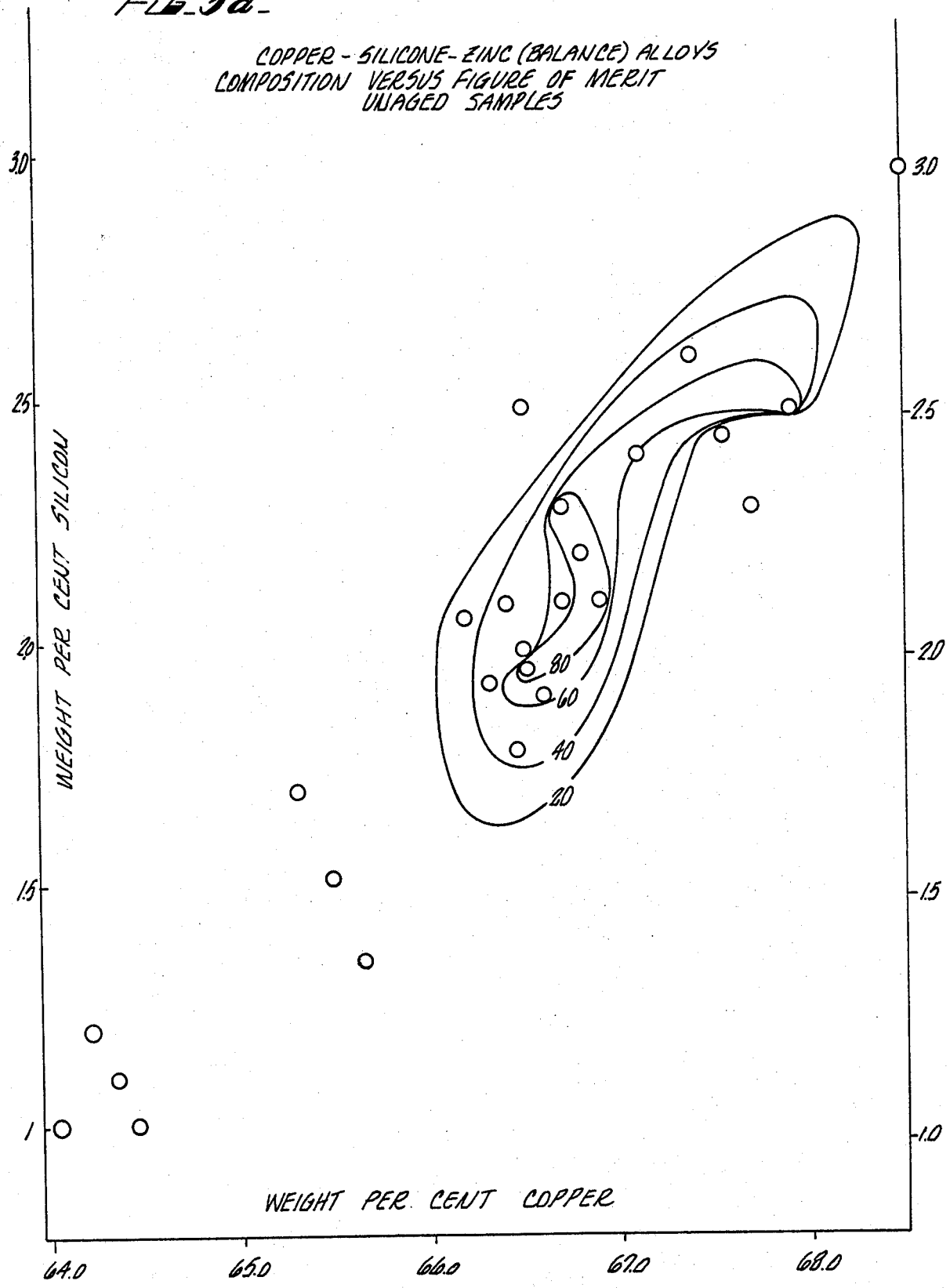
FIGS. 3*a* and 3*b* show the effect of slow heating on a variety of alloys comprising copper, zinc and silicon.
Figure 3B:
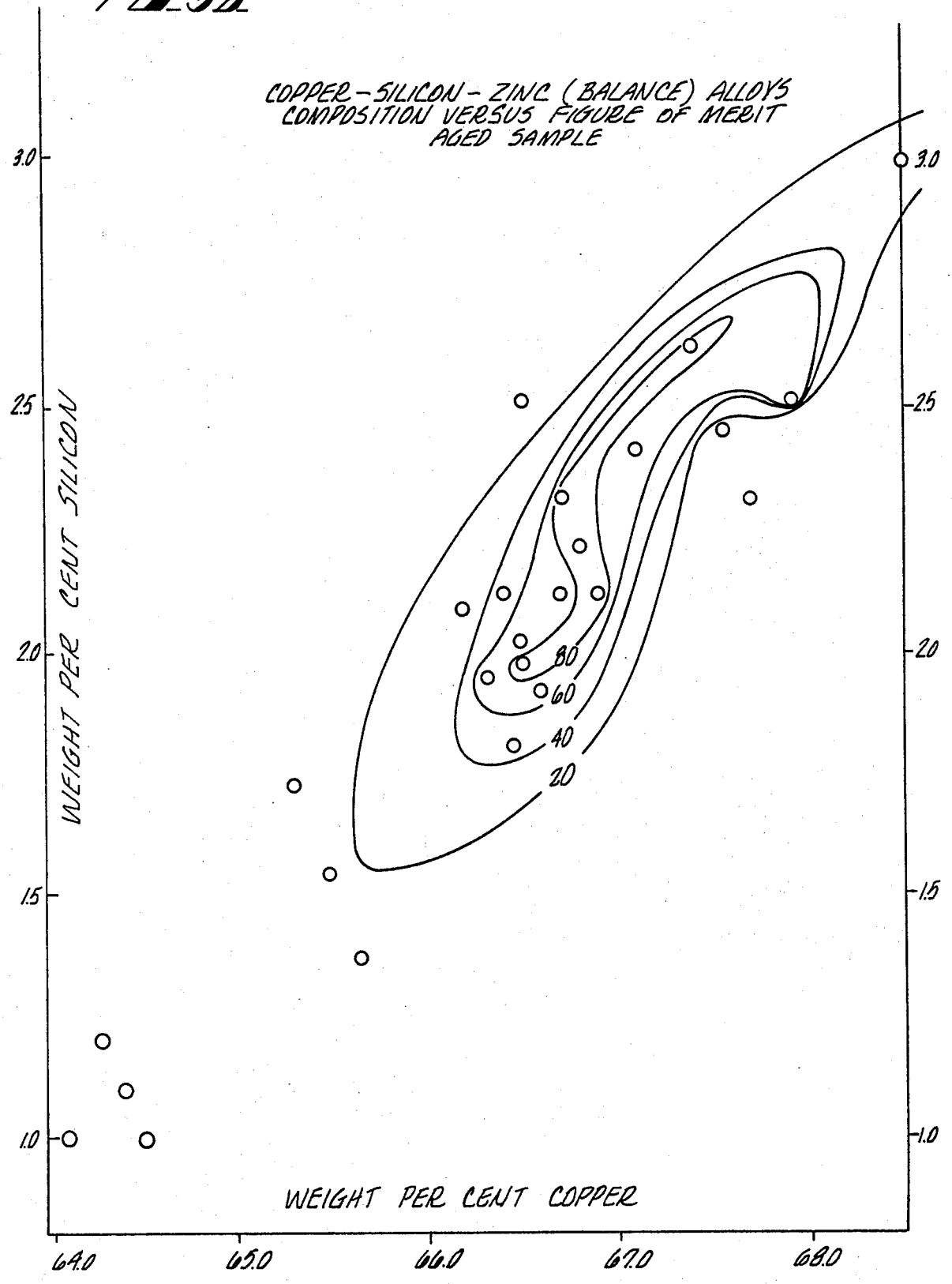

Referring now to FIGS. 3*a* and 3*b*, the figure-of-merit is plotted versus composition in FIGS. 3*a* and 3*b* in a topographical format. Generally, the long axes of the zones of constant figure-of-merit are parallel to iso-transformation temperature contours. Compositions with lower transformation temperatures are in the upper left while those with higher transformation temperatures are in lower right of the figure. A distinct optimum appears in FIG. 3 in the range 1.8 to 2.7 Si, 66.2 to 67.5 Cu, balance Zn (29.8 - 32.0%). Comparison of FIG. 3*a* with 3*b* shows that aging 10 minutes at 100° C broadens the optimum from the same general centre point. The arbitrary selection of 40° C as the end of slow heating apparently disqualifies alloys whose usual transformation range lies above or partially above +40° C, those in the lower right portion of the figure, but it will be appreciated that a zero on the graph does not indicate unsuitability of these alloys for use in the invention, merely that a temperature of other than +40° C should be chosen. Similarly, for those alloys in the upper left portion of the figure, a zero on the graph does not necessarily mean that they are not responsive to the process of the invention. In these cases, a zero merely means that the rate of slow heating selected was not one that prevented recovery prior to reaching 40° C. However those alloys with Figures-of-Merit above zero must be regarded as having responded to the slow heating treatment of the present invention and slow heating at a different rate may give better results. The choice of 40° C causes the iso-figure-of-merit zone to close toward the high transformation temperature side (lower right). Alloys in the lower right region are responsive to the process of this invention, as the CuZnAl data below indicate.

Figure 4:
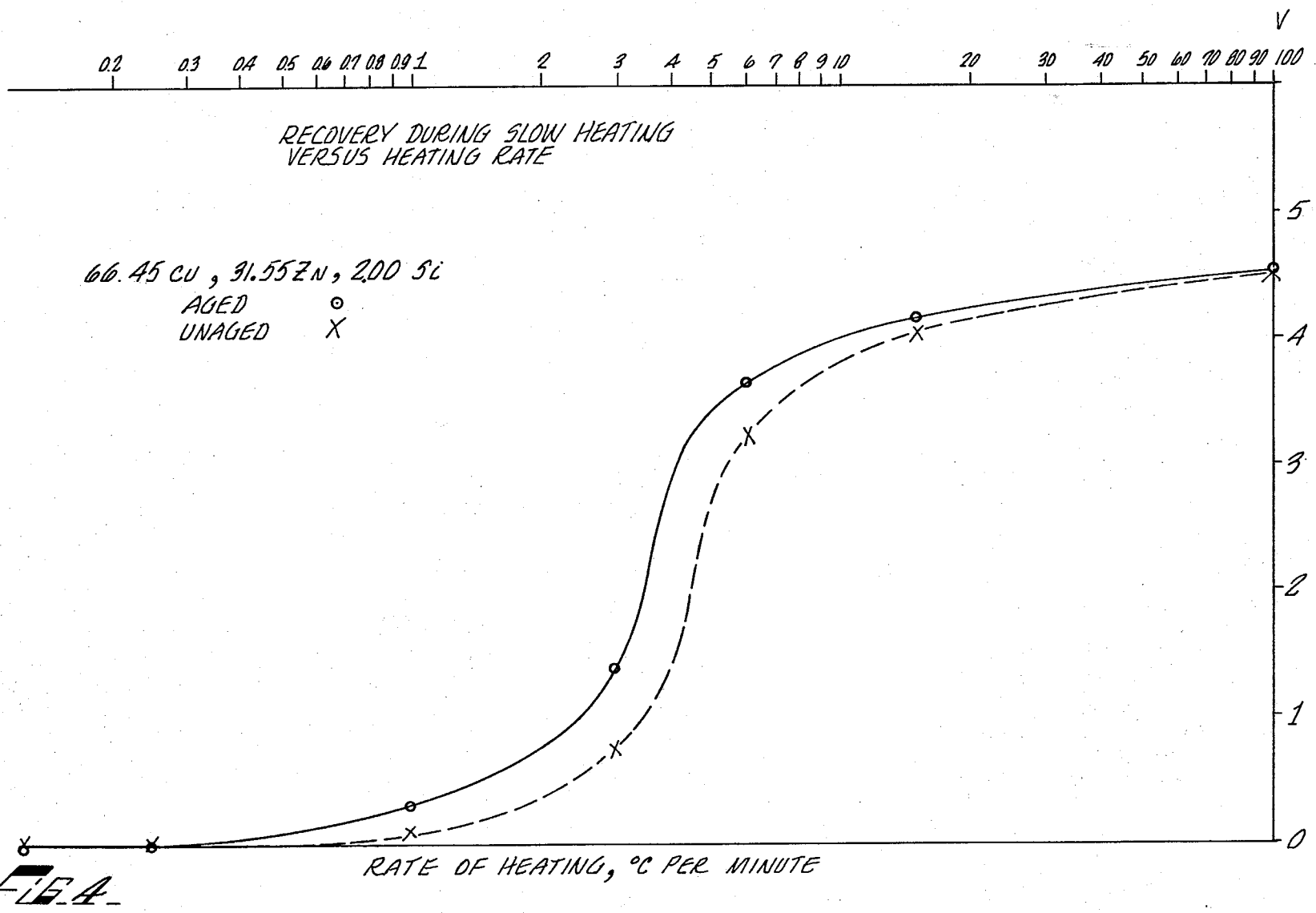
FIG. 4 shows the effect of heating rate on recovery of a heat recoverable alloy.

Sensitivity of the optimum region to the rate of slow heating was explored by testing samples of composition 66.45 wt. % Cu, 31.55 wt. % Zn, 2.0 wt. % Si, prepared as the samples above but slowly heated at a range of different heating rates. The recovery which occurred during heating through the temperature interval from −79° C to +40° C versus heating rate is presented in FIG. 4. Slow heating rates up to about 1 deg. C per minute are usable. Higher rates than 2 deg. C per minute lead to appreciable recovery during slow heating, indicating that about 2 deg. C per minute is the limit of "slow" heating for this system.

Figure 5:
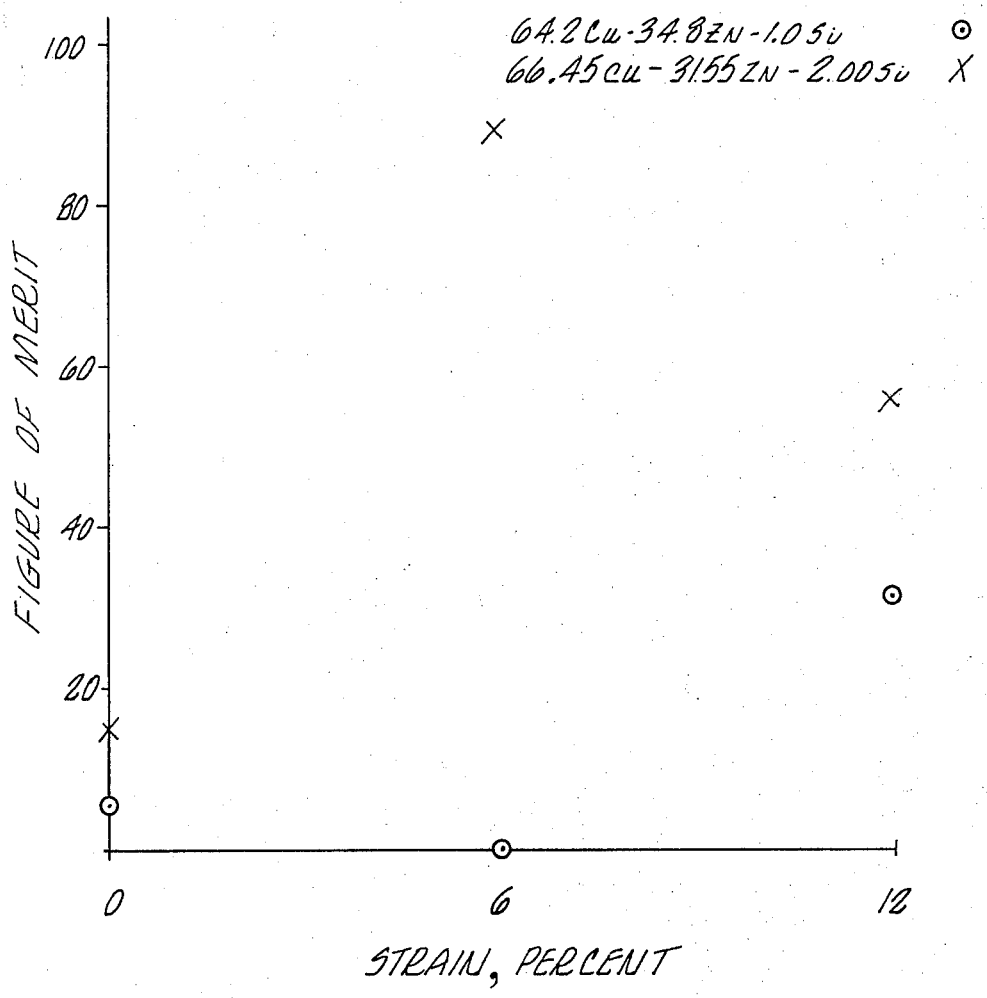
FIG. 5 shows the effect of strain on the responsiveness of alloys to the method of this invention.

Sensitivity of the optimum region to the rate of strain of the tests above was explored using compositions 66.45 wt. % Cu, 31.55 wt. % Zn, 2.0 wt. % Si, and 64.2 wt. % Cu, 34.8 wt. % Zn, 1.0 wt. % Si. One group of samples was treated according to the method above, except that 12% strain was introduced at −79° C. Another group was treated as above, but with zero strain before the slow heat step. After slow heating, the unstrained samples were strained 12% at room temperature, then all samples werre rapidly heated to +200° C. A figure of merit was determined for each by the sample method described above, except that 10% (assumed ideal recovery for 12% strain) is in the denominator rather than 5%. The results are illustrated in FIG. 5. While twelve percent strain appears to be beyond optimum for 66.45 wt. % Cu, 31.55 wt. % Zn, 2.0 wt. % Si, it gives better response in the 64.2 wt. % Cu, 34.8 wt. % Zn, 1.0 Si than 0 or 6% strain.

Figure 6A:
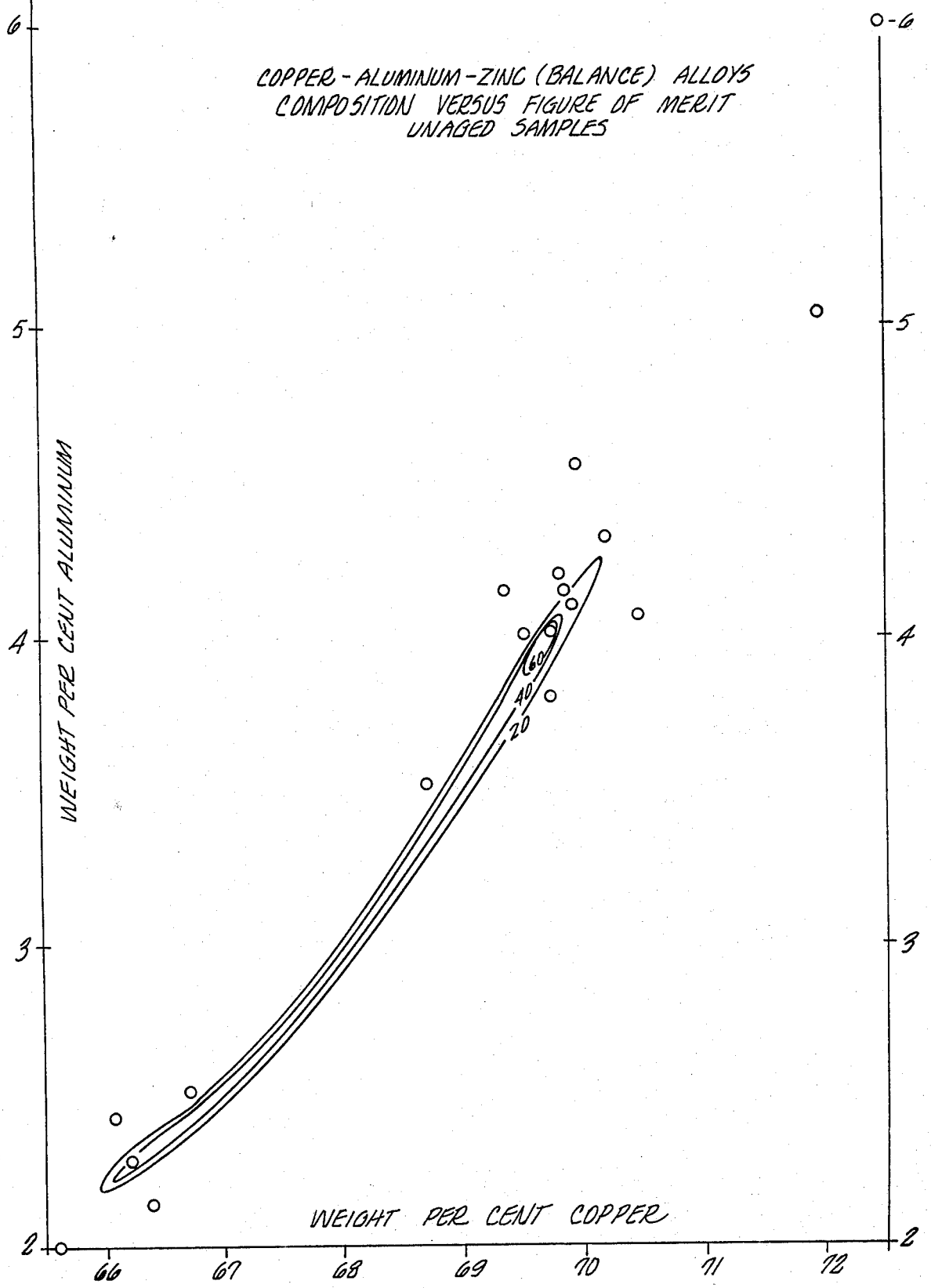
FIGS. 6*a*, 6*b* and 6*c* show the effect of slow heating on a variety of alloys comprising copper, aluminum and zinc.
Figure 6B:
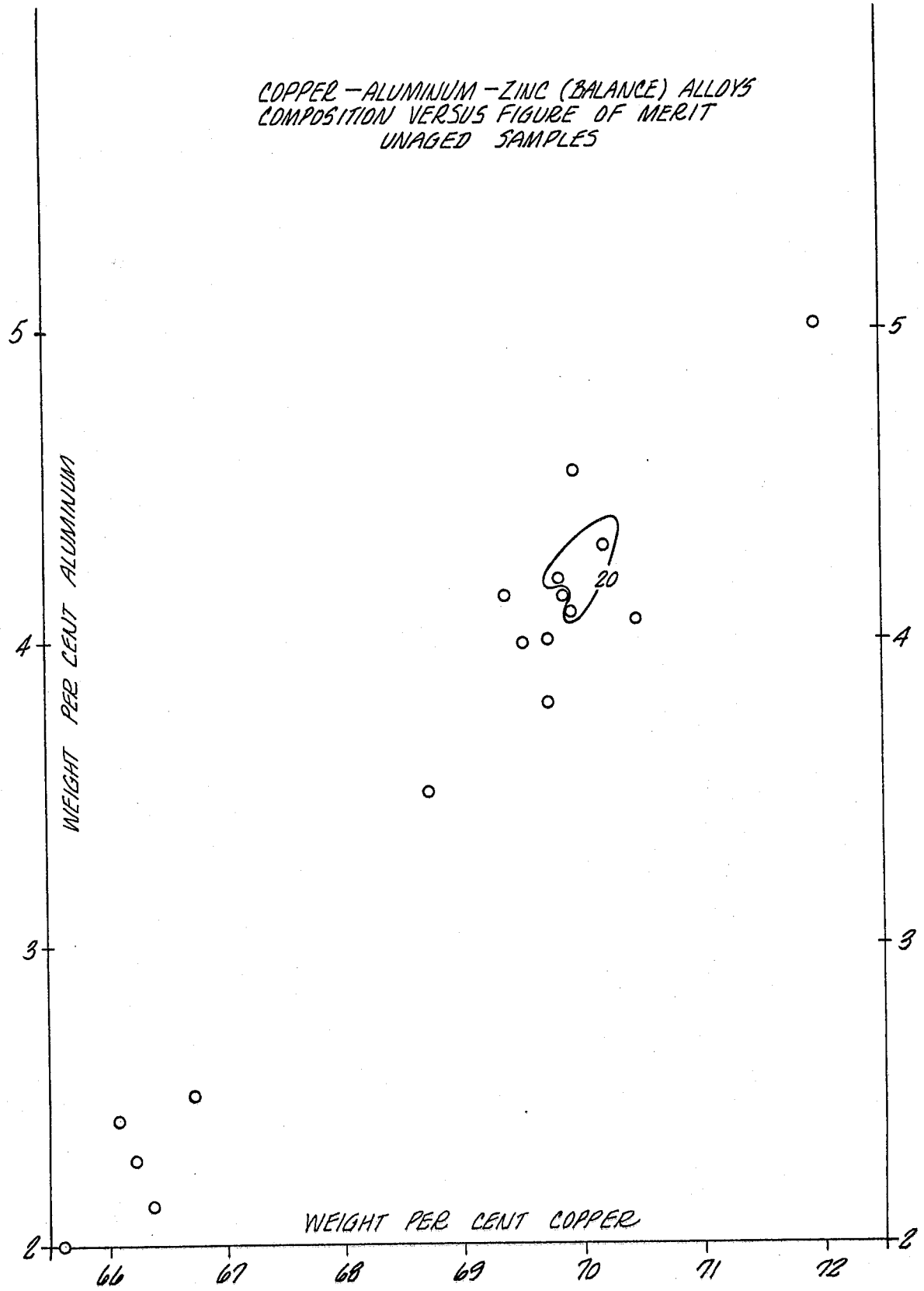
Figure 6C:
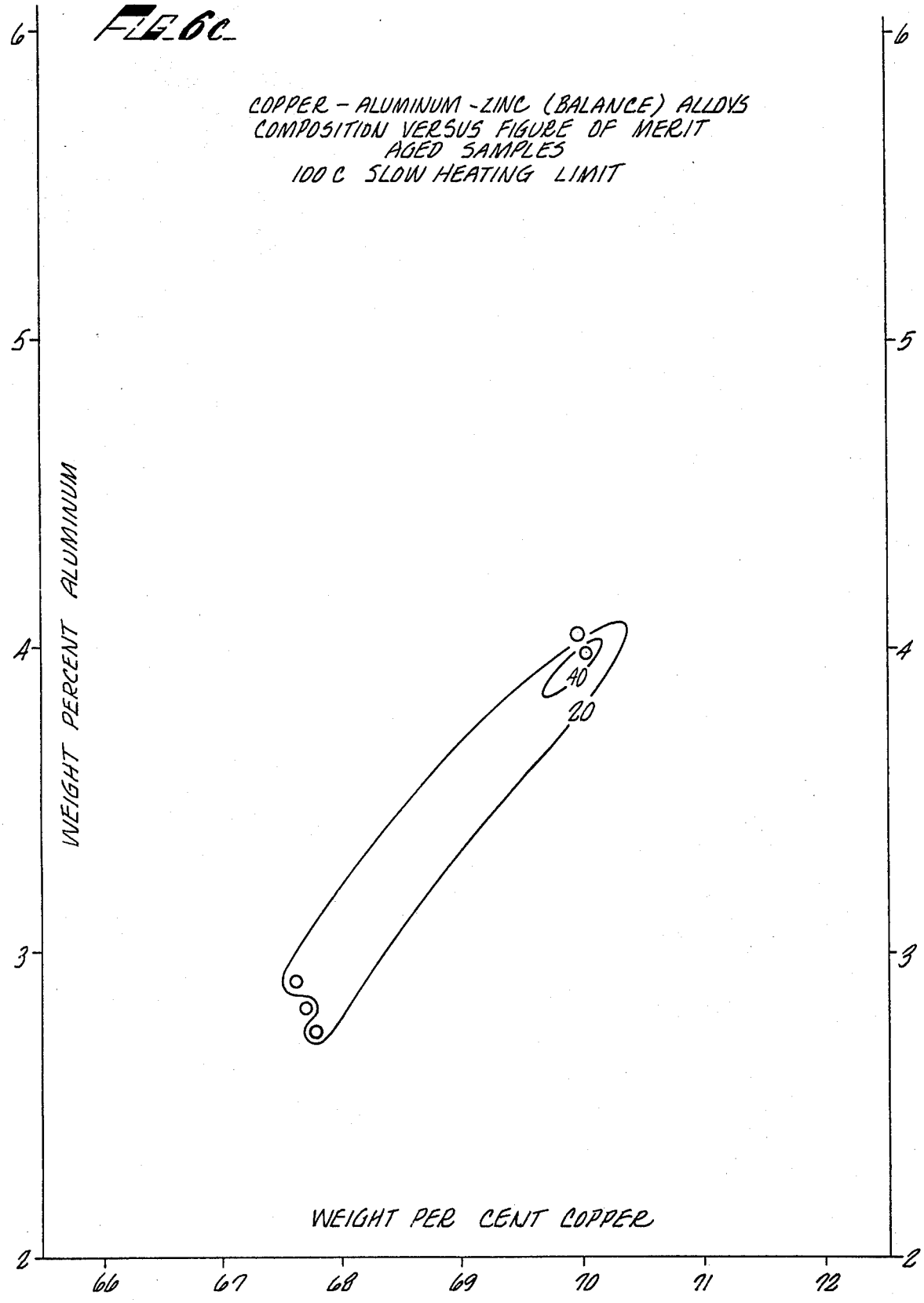

A topographical presentation of the figure-of-merit results for the CuZnAl system appears in FIG. 6. Again, the constant figure-of-merit zones lie parallel to the iso-transformation contours. A more distinct optimum region was defined by the unaged samples, FIG. 6*a* than for the aged, FIG. 6*b*.

Five alloy compositions having a normal $A_s$ at or above 40° C were used to test the mobility of the recovery range at higher temperatures. Again, the same general test procedure was used, but slow heating was continued to +100° C rather than stopping at +40° C. Results for aged samples appear in FIG. 6*c*; the new optimum lies parallel to that in FIG. 6*b*, but shifted as would be expected toward compositions with higher transformation temperatures. Although the recovery range is mobile in CuZnAl, the mobility seems more limited than in CuZnSi.

As the unaged CuZnAl samples lost their memory properties as a consequence of slow heating to 100° C, but the aged samples did not, it is apparent that the aging treatment is successful in preserving recoverability of the transformation in the higher temperature range.

It will be appreciated that the aging periods and conditions selected for FIGS. 3*b* and 6*b* result in certain compositions having optimum properties and that other aging periods and conditions result in different compositions having the same or broadly similar optimum properties. The aged alloys within the areas bonded by lines 40, 60 and 80 in FIG. 3*b* and line 20 in FIG. 6*b* are especially suited for the process of the invention.

The purpose of this Example is to show how an optimum composition can be selected, given a desired set of characteristics. Examples to follow will show how characteristics can be changed to optimize movement of the recovery range for the case of a fixed alloy composition. For example, the optimum range of Example 1 may give too low ductility or too low electrical conductivity for specific applications.

EXAMPLE 2

Several specimens of an alloy of composition, by weight, of 64.5% copper, 34.5% zinc, 1.0% silicon were quenched after 5 minutes at 860° C into water at 20° C, and then aged at 50° C for times up to 1 week. After cooling to below $M_f$ the specimens were reheated at a rate of 10 to 20° C/minute. Little transformation of martensite to β-phase (as measured by changes in resistivity) occurred during heating of the specimen aged for 5 minutes. Some transformation took place in the specimen aged for 45 minutes; the specimens aged for 90 minutes or over transformed completely. Other specimens of the same alloy were given the same treatment and after aging were deformed in tension at −50° C and reheated. The amount of heat-recovery was approximately proportional to the amount of martensite which had transforned in the resistivity tests on undeformed specimens. Hence, using the process of the invention by aging at least 45 minutes allowed permanent heat-recoverable properties to be imparted to this alloy.

After aging 5 minutes at 20° C before cooling to −50° C, the heat recoverable strain was 2.30%. After 45 minutes, at +50° C befofe cooling to −50° C, the heat recoverable strain was 6.20%. This slowly increased after longer aging times to 6.50% after 3 hours and 7.0% after 1 week. This example does not relate to thermal preconditioning.

EXAMPLE 3

Several samples of an alloy of composition by weight of 66.50% copper, 31.75% zinc and 1.75% silicon were also quenched after 5 minutes at 860° C into water at 20° C. They were then aged at 50° C for times up to 1 week. After 4 minutes at 20° C, the heat recoverable strain was 0.1%. After 45 minutes at 50° C, this remained at 0.1% and after 90 minutes had only increased to 0.55%. Three hours increased the heat recovery strain to 0.70%, 1 day to 1.0% and 2 days to 3.9%. Thus, the increased silicon content can be seen to require much longer aging time to produce improved recovery.

EXAMPLE 4

The alloy described in Example 2 was also used in this Example. Its basic $A_s$ was about 15 to 25° C, and normally about 75% any heat recovery has taken place by 75° C. A sample was heat treated and quenched in the manner described in Example 1 and aged for about 5 minutes at ambient temperature. It was then cooled to below $M_f$ to the martensitic state, then heated at between 0.75 and 10° C per minute at 75° C, and then cooled to −50° C (i.e., below its $M_f$ of about −20° C). The sample was then deformed to impart 8% strain at −50° C. Approximately half the deformation strain was recovered on heating to above $A_f$. Recovery was 4%, about 0.8% taking place below, and 3.2% above, 75° C.

EXAMPLES 5 to 8

Samples of the same alloy used in Example 2 were heat treated and quenched to 20° C, and aged for 2 days at 50° C. They were then cooled to −50° C and deformed. Samples were then heated to 75° C at the same slow rate as in Example 4, and cooled again to 20° C. Different samples were then stored for different periods, and heated at 50 to 200° C/minute (i.e., rapidly) to cause recovery.

| Ex. No. | Strain | Recovery on Slow Heat to 75° C | Storage Time at Ax, 20° C | Recovery on Fast Heat to 75° C | Total Recovery on Fast Heat % |
|---|---|---|---|---|---|
| 5 | 7.40 | 0.95 | 5 min. 85 | 0 | 5.30 |
| 6 | 6.80 | 1.20 | 90 min. 86 | 0 | 4.40 |
| 7 | 7.65 | 1.60 | 16 hrs. 85 | 0 | 4.30 |
| 8 | 7.30 | 1.60 | 168 hrs. 86 | 0 | 3.60 |

From Examples 4 to 8 it can be seen that the alloys may be deformed either before or after slow heating.

EXAMPLE 9

Three samples of an alloy having $M_s$ of −40° C (63.7% copper, 35.3% zinc, 1% silicon) were quenched from 850° C into water at +20° C and transferred to alcohol at −70° C; all samples were martensitic at this stage. Two samples then had a deformation of 5% introduced. One deformed and the undeformed sample were heated at 10° C per hour (slow heating), the other deformed sample was heated at 10° C per minute (fast heating). In the undeformed sample heated slowly transformation took place between −46° and −32° C. In the deformed sample heated slowly, transformation did not start until +30° C. At this stage, it was heated rapidly; 3.7% of the deformation was immediately recovered; all 5% was recovered by 80° C. In the deformed sample heated rapidly from −70° C, recovery started at about −46° C and all deformation was recovered by −10° C. Thus, deformation and heating rate both affect $A_s$.

EXAMPLE 10

A copper-zinc alloy contaning 1% silicon and having a basic $M_s$ of 0° C, $A_s$ of −10° C, $A_f$ of +12° C, was used.

A sample was quenched from 850° C into water at 20° C and then transfered to alcohol at −40° C and deformed 4%. The sample was then heated slowly to +40° C, no recovery taking place. The sample was then recooled to −40° C and rapidly reheated to +40° C. No recovery of deformation took place on rapid reheating. To effect recovery, the sample was heated above +40° C.

Subsequent to recovery, the sample was again cooled to −40° C, deformed and heated rapidly. Recovery was complete by 20° C, behaviour consistent with the original $A_f$ of 12° C.

EXAMPLE 11

Sixteen samples of 80.8 wt. % Cu, 10.5 wt. % Al, 8.7 wt. % Mn were betatized at 800° C or 900° C for 3 minutes or 6 minutes, then quenched into room temperature water. Half the samples were aged for 10 minutes at 100° C, the others were not aged. All samples were deformed by bending at −79° C to give an outer fibre strain of 6%, then the stress was relaxed. Half the samples were heated to 100° C at 0.25° C. per minute, cooled to room temperature, then heated rapidly to 200° C. The other half were heated rapidly to 100° C, cooled to room temperature, then heated rapidly to 200° C. The rate of rapid heating was greater than 100° C per minute. An analysis of the strain which was recovered during rapid heating to 200° C versus the controlled variables indicated that thermal preconditioned significantly increased the proportion of recovery taking place above 100° C. For this particular alloy, a statistical analysis indicated that aging had no effect.

Averaged effects:

Percent Strain recovered above 100° C

Fast heated 0.39 percent

Preconditioned 1.89 percent

The experiment was repeated on an alloy containing 80.49 wt. % Cu, 10.5 wt. % Al, 9.01 wt. % Mn. Analysis of the strain which was recovered during rapid heating to 200° C versus the controlled variables showed significance for aging versus no aging and for non-preconditioned versus preconditioned.

Averaged effects:

Percent Strain Recovered above 100° C

Un-aged 1.00 Fast Heated 0.15 Aged 0.36 Preconditioned 1.21

EXAMPLE 12

Samples of an alloy containing 79.2 wt. % Cu, 10.0 wt. % Al and 10.8 wt. % Mn were betatized at 550° C for 5 minutes and quenched into water at 20° C. The alloy had an $M_s$ of −20° C as a result of this treatment. Samples were either aged for 5 minutes of 1 hour at 50° C, then cooled to −30° C, or cooled to −30° C immediately after the water quenching without aging. All the samples were deformed 4% in tension and −30° C and the stress released.

Half of the samples were immediately heated at a very rapid rate by immersion in liquids at 20° C, 40° C, 100° C and 200° C. The incremental amount of strain recovered as a result of each immersion was recorded.

The remaining samples were initially slow heated at 6° C/minute to 40° C, after which they were recorded to −30° C and rapidly heated, as in the first set of samples. The results are shown in the table on the next page.

Considering first those samples rapidly heated immediately after deformation, recovery was complete by 40° C in th samples aged 5 min. and 1 hr., but most recovery took place above 40° C in the unaged sample. In the samples initially heated at 6° C/min to 40° C, no recovery took place by 40° C in this first heating cycle in the unaged samples and those samples aged 5 min at 50° C. However, after recooling and rapid heating again, most recovery took place above 40° C. The sample aged 1 hr. at 50° C showed almost complete recovery in the initial heating cycle of 6° C/min to 40° C.

TABLE

| Result | Strain (%) | Aging Temp. (° C) | Aging Time | Heating Rate | Recovery by 40° C (% Strain) | Recovery Above 40° C (% Strain) |
|---|---|---|---|---|---|---|
| 1. | 3.8 | Unaged | | Rapid only | 1.4 | 2.1 |
| | | | | 6° C/min to 40° C, re- | 0 | — |
| 2. | 3.3 | Unaged | | cool & rapid heat | 0.3 | 1.2 |
| 3. | 3.2 | 50° C | 5 min | Rapid only | 3.1 | 0 |
| | | | | 6° C/min to 40° C, re- | 0.3 | — |
| 4. | 3.7 | 50° C | 5 min | cool and rapid heat | 0.3 | 2.8 |
| 5. | 3.6 | 50° C | 1 hr. | Rapid only | 3.35 | 0 |
| | | | | 6° C/min to 40° C, re- | 2.5 | — |
| 6. | 3.4 | 50° C | 1 hr. | | 0.3 | 0.1 |

These observations demonstrate that aging lowers the $A_s$ since in unaged samples significant recovery took place above 40° C without preconditioning (Compare Results 1, 3 and 5). However, the amount of heat recoverable strain obtained when a sample is thermally preconditioned is improved by aging. (Compare Results 2 and 4). Aging also affects the rate of slow heating necessary for thermal preconditioning. For a sample aged but 5 min. at 50° C, 6° C/min was a "slow" heating rate as there was little recovery before 40° C. (See Result 4) However, in the case of a sample aged for 1 hr. at 50° C, a heating rate of 6° C/min qualified as a fast heating rate as most of the heat recoverable strain was recovered during the attempt to precondition. The combined effect of these results is to demonstrate that for a given alloy, there may be an optimum aging treatment, one, however, that is readily determined by those skilled in the art, prior to thermal preconditioning.

In the descriptions above, emphasis has been placed on shape memory and simple recovery. Other modifications made possible by this invention include such techniques as fast heating to give partial recovery, followed by slow heating to set an elevated recovery range, followed by cooling to the low-temperature structure range, then re-deforming. This gives a product which, upon rapid heating, recovers in two steps, one at the usual range for the beginning of recovery on rapid heating, the other starting at the elevated recovery range. This technique can be multiply applied with a succession of slow heating steps to give a multiplicity of recovery ranges. Likewise, the resistivity can be made to vary in a stepped fashion on heating.

The invention can be used as a technique for extending the range of the low-temperature structure to higher temperatures. This can give alloys with high fatigue resistance to strains of about 10%, good damping properties, unusual colour, or any other characteristic which accompanies the low-temperature structure.

We claim:

1. A method for expanding the hysteresis loop of a metallic composition in its martensitic state, said hysteresis loop being defined by the $M_f$, $M_s$, $A_f$ and $A_s$ temperatures, comprising slowly heating said composition to a temperature above the normal $A_s$ to impart an elevated temperature $A_s$, hereinafter referred to as $A_{se}$, terminating the slow heating and deforming said composition while in the martensitic state to impart heat recoverability.

2. The method of claim 1 wherein said slow heating is terminated by cooling to a temperature below said $A_{se}$.

3. The method of claim 1 wherein said slow heating is terminated by rapid heating.

4. The method of claim 1 wherein said composition is deformed before slow heating.

5. The method of claim 1 wherein said composition is cooled to a temperature below $A_{se}$ and is then deformed.

6. The method of claim 1 wherein said composition is held at a temperature above the $M_s$ temperature while in the austenitic state for a time sufficient to reduce the loss of reversibility between the martensitic and austenitic states prior to converting the composition to its martensitic state.

7. The method of claim 6 wherein prior to said holding step, said composition is heated to a temperature substantially above room temperature and is then quenched.

8. The process of claim 7 wherein said quenching temperature is a temperature at which the composition is wholly in the austenitic state.

9. A method according to claim 1 wherein said slow heating is at a rate sufficiently slow to substantially prevent martensite reversal to austenite at and above the normal $A_s$ temperature for said alloy.

10. The method of claim 3 wherein said rapid heating is at a rate at which the composition reverts from its martensitic state to its austenitic state.

11. The method of claim 1 wherein said metallic composition is an alloy comprising copper and a metal selected from the group consisting of zinc and aluminum.

12. The method of claim 11 wherein said alloy contains a third metal selected from the group consisting of aluminum, manganese, silicon and tin.

13. A method according to claim 1 wherein said deformed composition is heated to a temperature above $A_{se}$ at a rate at which the composition reverts from its martensitic state to its austenitic state.

14. A metal capable of reversible transformations between an austenitic state and a martensitic state with changes in temperature, said metal being the product of the process comprising the steps:

(a) cooling the metal from a temperature at which it exists in the austenitic state to a temperature at which it exists in the martensitic state;

(b) heating the metal to a temperature above that at which reversion to the austenitic state normally occurs, said heating being at a rate at which the composition remains substantially in its martensitic state;

(c) terminating said heating at said temperature; and (d) cooling the metal from said temperature to a lower temperature;

thereby elevating the temperature at which the metal will begin reversion from the martensitic state to the austenitic state to the temperature at which the heating is terminated said metal having been deformed while in the martensitic state from a configuration it possessed in the austenitic state to render the metal heat recoverable.

15. A metal according to claim 14 wherein said deforming is accomplished prior to said heating step.

16. A metal according to claim 14 wherein said deforming is accomplished after cooling of the metal from the temperature at which heating is terminated.

17. A metal according to claim 14 wherein said metal is an alloy comprising copper and an element selected from the group consistig of zinc and aluminum.

18. The alloy of claim 17 wherein said element is zinc.

19. The alloy of claim 18 wherein said alloy contains a third element selected from the group consisting of aluminum, manganese, silicon and tin.

20. The alloy of claim 17 wherein said element is aluminum.

21. The alloy of claim 20 wherein said alloy contains a third element selected from the group consisting of manganese, silicon, tin and zinc.

22. The alloy of claim 19 comprising 66.2–67.5 wt. % Cu, 29.8–32.0 wt. % Zn, and 1.8–2.7 wt. % Si.

23. The alloy of claim 19 comprising by weight 69.7% Cu, 26.3% Zn, and 4% Al.

24. The alloy of claim 19 comprising by weignt 66.2% Cu, 37.3% Zn, and 0.5% Al.

25. The alloy of claim 19 comprising by weight 64.5% Cu, 34.5% Zn, and 1% Si.

26. The alloy of claim 19 comprising by weight 66.5% Cu, 31.75% Zn, and 1.75% Si.

27. The alloy of claim 19 comprising by weight 63.7% Cu, 35.3% Zn, and 1% Si.

28. The alloy of claim 19 comprising by weight 66.45% Cu, 31.55% Zn, and 2.00% Si.

29. The alloy of claim 19 comprising by weight 66.5% Cu, 30.8% Zn, and 19.6% Si.

30. The alloy of claim 19 comprising by weight 64.2% Cu, 34.8% Zn, and 1.0% Si.

31. The alloy of claim 19 comprising by weight 80.5% Cu, 10.5% Zn, and 9% Al.

32. The alloy of claim 21 comprising by weight 80.5% Cu, 10.5% Al, and 9% Mn.

33. The alloy of claim 21 comprising by weight 80.8% Cu, 10.5% Al, and 8.7% Mn.

34. The alloy of claim 21 comprising by weight 80.49% Cu, 10.5% Al, and 9.01% Mn.

35. The alloy of claim 21 comprising by weight 79.2% Cu, 10.0% Al, and 10.8% Mn.

36. A metal according to claim 14 having an elongation to failure of at least 5%.

37. A metal according to claim 14 wherein said metal is storage stable under atmospheric conditions.

38. A metal according to claim 14 wherein the heating rate is less than 1° C/min.

39. A metal according to claim 14 wherein said metal has a $M_s$ below room temperature.

40. A heat recoverable metallic article comprising a metal capable of reversible transformations between an austenitic state and a martensitic state with changes in temperature, said article being the product of the process comprising the steps:

(a) fabricating said article in an original configuration;

(b) cooling the article from a temperature at which the metal exists in the austenitic state to a temperature at which it exists in the martensitic state;

(c) deforming the article from its original configuration to a second configuration from which recovery is desired;

(d) heating the article to a temperature above that at which the metal normally undergoes reversion to the austenitic state, said heating being at a rate at which the metal remains substantially in its martensitic state;

(e) terminating said heating at said temperature; and (f) cooling the article from said temperature to a lower temperature,

41. An article according to claim 40 wherein the heating rate is less than 1° C/min.

42. A heat recoverable metallic article comprising a metal capable of reversible transformations between an austenitic state and a martensitic state with changes in temperature, said article being the production of the process comprising the steps:

(a) fabricating said article in an original configuration;

(b) cooling the article from a temperature at which the metal exists in the austenitic state to a temperature at which it exists in the martensitic state;

(c) heating the article to a temperature above that at which the metal normally undergoes reversion to the austenitic state, said heating being at a rate at which the metal remains substantially in its martensitic state;

(d) terminating said heating at said temperature;

(e) cooling the article from said temperature to a lower temperature; and (f) deforming the article from its original configuration to a second configuration from which recovery is desired, thereby elevating the temperature at which the article will begin recovery towards its original configuration to the temperature at which slow heating is terminated.

43. An article according to claim 42 wherein the heating rate is less than 1° C/min.

* * * * *